US007614234B2

(12) United States Patent
Cazalens et al.

(10) Patent No.: US 7,614,234 B2
(45) Date of Patent: Nov. 10, 2009

(54) TURBOMACHINE COMBUSTION CHAMBER WITH HELICAL AIR FLOW

(75) Inventors: Michel Pierre Cazalens, Bourron Marlotte (FR); Romain Nicolas Lunel, Montereau sur le Jard (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 12/199,116

(22) Filed: Aug. 27, 2008

(65) Prior Publication Data

US 2009/0056338 A1 Mar. 5, 2009

(30) Foreign Application Priority Data

Sep. 5, 2007 (FR) ..... 07 57356

(51) Int. Cl.
*F02C 3/00* (2006.01)

(52) U.S. Cl. ..... 60/746; 60/752

(58) Field of Classification Search ..... 60/752–760, 60/746, 747, 800; 439/9, 182, 183, 187, 439/350

See application file for complete search history.

(56) References Cited

U.S. PATENT DOCUMENTS 5,025,622 A 6/1991 Melconian 5,417,069 A * 5/1995 Alary et al. ..... 60/747

FOREIGN PATENT DOCUMENTS

GB 719380 12/1954

OTHER PUBLICATIONS

U.S. Appl. No. 12/137,863, filed Jun. 12, 2008, Cameriano, et al.

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, L.L.P.

(57) ABSTRACT

The invention relates to a turbomachine combustion chamber having an inner wall, an outer wall surrounding the inner wall so as to co-operate therewith to define a space forming a combustion area, a transverse wall interconnecting the inner and outer walls, and fuel injection systems. The inner wall has a plurality of inner steps each extending radially towards the outside of the inner wall, the circumferential spacing between two adjacent inner steps defining an inner cavity. The outer wall includes a plurality of outer steps each extending radially towards the inside of the outer wall, the circumferential spacing between two adjacent inner steps defining an outer cavity. At least some of the inner and outer cavities are fed with air from outside the combustion chamber in a common direction that is circumferential, and with fuel in a direction that is radial.

17 Claims, 3 Drawing Sheets

TURBOMACHINE COMBUSTION CHAMBER WITH HELICAL AIR FLOW

BACKGROUND OF THE INVENTION

The present invention relates to the general field of combustion chambers for turbomachines, whether for aviation or terrestrial purposes.

Typically, an aviation or terrestrial turbomachine is made up of an assembly that comprises in particular an annular compression section for compressing the air passing through the turbomachine, an annular combustion section disposed at the outlet from the compression section and within which the air coming from the compression section is mixed with fuel in order to be burnt therein, and an annular turbine section disposed at the outlet from the combustion section and having a rotor that is driven in rotation by the gas coming from the combustion section.

The compression section is in the form of a plurality of stages of moving wheels, each carrying blades that are placed in an annular channel through which the turbomachine air passes, the channel being of section that decreases going from upstream to downstream. The combustion section comprises a combustion chamber in the form of an annular channel in which the compressed air is mixed with fuel in order to be burnt therein. The turbine section is made up of a plurality of stages of moving wheels, each carrying blades that are placed in an annular channel through which the combustion gas passes.

The flow of air through the above assembly generally takes place as follows: the compressed air coming from the last stage of the compression section presents natural gyratory motion with an angle of inclination of the order of 35° to 45° relative to the longitudinal axis of the turbomachine, which angle of inclination varies as a function of the speed of rotation of the turbomachine. On entry into the combustion section, this flow of compressed air is straightened along the longitudinal axis of the turbomachine (i.e. the angle of inclination of the air relative to the longitudinal axis of the turbomachine is reduced to 0°) by means of a guide vane. The air in the combustion chamber is then mixed with the fuel so as to provide satisfactory combustion, and the gas generated by the combustion continues to flow generally along the longitudinal axis of the turbomachine in order to reach the turbine section. Once there, the combustion gas is redirected by a nozzle in order to present gyratory motion with an angle of inclination greater than 70° relative to the longitudinal axis of the turbomachine. Such an angle of inclination is essential for producing the angle of attack that is needed to provide the mechanical force for driving rotation of the moving wheel of the first stage of the turbine section.

Such a distribution of angles of inclination for the air passing through the turbomachine presents numerous drawbacks. The air that naturally leaves the last stage of the compression section with an angle of inclination lying in the range 35° to 45° is successively straightened (its angle is reduced to 0°) on entry into the combustion section, and then redirected to have an angle of inclination greater than 70° on entry into the turbine section. These successive changes of angle of inclination in the flow of air through the turbomachine require intense aerodynamic forces to be produced both by the guide vane of the compression section and by the nozzle of the turbine section, which aerodynamic forces are particularly damaging to the overall efficiency of the turbomachine.

OBJECT AND A SUMMARY OF THE INVENTION

The present invention seeks to remedy the above-mentioned drawbacks by proposing a turbomachine combustion chamber capable of being fed with air that possesses rotary motion relative to the longitudinal axis of the turbomachine.

This object is achieved by a combustion chamber comprising:

an inner annular wall of longitudinal axis;

an outer annular wall centered on the longitudinal axis and surrounding the inner wall so as to co-operate therewith to define an annular space forming a combustion area;

a transverse annular wall transversely interconnecting the upstream longitudinal ends of the inner and outer walls; and a plurality of fuel injection systems;

wherein:

the inner wall includes a plurality of inner steps that are regularly distributed around the longitudinal axis, each inner step extending longitudinally between the two longitudinal ends of the inner wall and radially towards the outside thereof, the circumferential spacing between two adjacent inner steps defining an inner cavity;

the outer wall includes a plurality of outer steps that are regularly distributed around the longitudinal axis, each outer step extending longitudinally between the two longitudinal ends of the outer wall and radially towards the inside thereof, the circumferential spacing between two adjacent inner steps defining an outer cavity; and at least some of the inner and outer cavities are fed with air external to the combustion chamber in a common direction that is substantially circumferential, and with fuel in a direction that is substantially radial.

The combustion area is fed with air via the inner and outer cavities in a direction that is substantially circumferential. The combustion chamber of invention can thus be fed or with air that presents rotary motion about the longitudinal axis of the turbomachine. The natural angle of inclination of the air at the outlet from the compression section of the turbomachine can thus be maintained through the combustion chamber. As a result, the aerodynamic design of the high-pressure turbine nozzle can be simplified, and the aerodynamic forces needed to bring the flow on to the axis of the turbomachine can then be substantially decreased. This great decrease in aerodynamic forces gives rise to an increase in the efficiency of the turbomachine. Furthermore, since the guide vane of the compression section and the nozzle of the turbine section are both simplified, that can lead to a saving in weight and to a reduction in production costs.

Furthermore, the presence of inner and outer cavities that need be supplied with fuel solely at idling speeds of the turbomachine, serves to stabilize the combustion flame for all operating speeds of the turbomachine.

In an advantageous provision, some of the inner and outer steps include respective substantially radial walls, each provided with a plurality of air-injection orifices opening to the outside of the combustion chamber and into the adjacent inner or outer cavity.

In another advantageous provision, each of the inner and outer steps includes a respective other wall that presents, in cross-section, a section that is substantially curvilinear.

In yet another advantageous provision, the fuel injection systems comprise pilot injectors alternating circumferentially with full-throttle injectors. Under such circumstances, the full-throttle injectors are offset axially downstream relative to the pilot injectors. The flames from the pilot injectors need to spend longer in the combustion area than the flames from the full-throttle injectors.

In yet another advantageous provision, the fuel injection systems do not include associated air systems (which generally serve to set air into rotation so as to create re-circulation in order to stabilize the combustion flame).

The invention also provides a turbomachine including a combustion chamber as defined above.

BRIEF DESCRIPTION OF THE DRAWINGS

Other features and advantages of the present invention appear from the description below made with reference to the accompanying drawings that show an embodiment that has no limiting character. In the figures.

DETAILED DESCRIPTION OF AN EMBODIMENT

Figure 1:
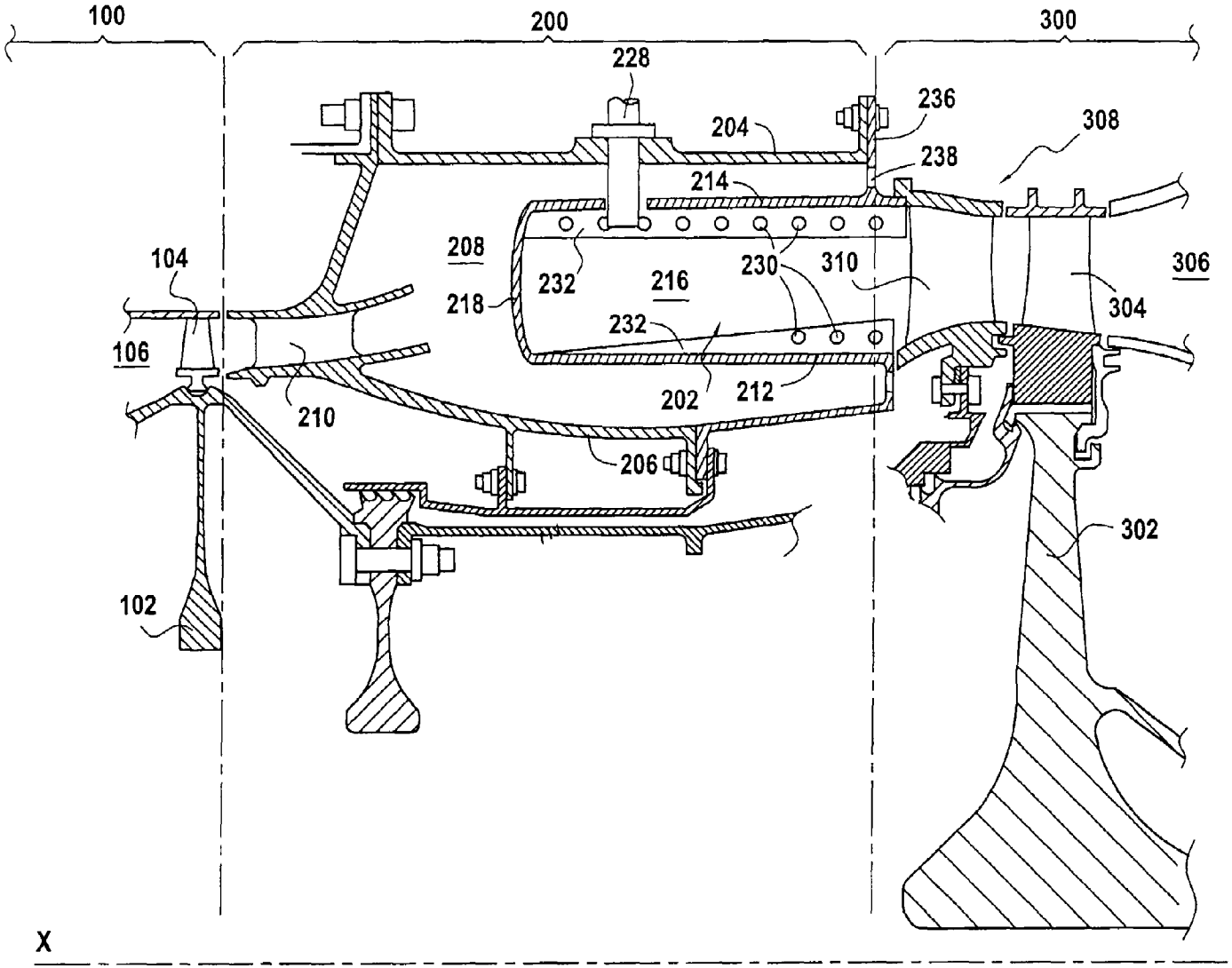
FIG. 1 is a fragmentary longitudinal section view of an aviation turbomachine fitted with a combustion chamber constituting an embodiment of the invention.

The turbomachine shown in part in FIG. 1 possesses a longitudinal axis X-X. On this axis, it comprises in particular: an annular compression section 100; an annular combustion section 200 at the outlet from the compression section 100 in the flow direction of air passing through the turbomachine; and an annular turbine section 300 located at the outlet from the combustion section 200. The air injected into the turbomachine thus passes in succession through the compression section 100, then the combustion section 200, and finally the turbine section 300.

The compression section 100 is in the form of a plurality of stages of moving wheels 102, each carrying blades 104 (only the last stage of the combustion section is shown in FIG. 1). The blades 104 of these stages are disposed in an annular channel 106 through which air passes along the turbomachine, and of section that decreases going from upstream and downstream. Thus, as the air injected into the turbomachine passes along the compression section, it becomes more and more compressed.

The combustion section 200 is likewise in the form of an annular channel along which the compressed air from the compression section 100 is mixed with fuel in order to be burnt therein. For this purpose, the combustion section includes a combustion chamber 202 within which the air/fuel mixture is burnt (this chamber is described in greater detail below).

The combustion section 200 also has a turbomachine casing formed by an outer annular shell 204 centered on the longitudinal axis X-X of the turbomachine, and an inner annular shell 206 that is fastened coaxially inside the outer shell. An annular space 208 formed between these two shells 204 and 206 receives the compressed air coming from the compression section 100 of the turbomachine.

The turbine section 300 of the turbomachine is formed by a plurality of stages of moving wheels 302, each carrying blades 304 (only the first stage of the turbine section is shown in FIG. 1). The blades 304 of these stages are placed in an annular channel 306 through which the gas coming from the combustion section 200 passes.

At the inlet to the first stage 302 of the turbine section 300, the gas coming from the combustion section needs to present an angle of inclination relative to the longitudinal axis X-X of the turbomachine that is sufficient to drive the various stages of the turbine section in rotation.

For this purpose, a nozzle 308 is mounted directly downstream from the combustion chamber 202 and upstream from the first stage 302 of the turbine section 300. The nozzle 308 is made up of a plurality of stationary radial vanes 310 of inclination relative to the longitudinal axis X-X of the turbomachine, and that serve to impart to the gas coming from the combustion section 200 the angle of inclination necessary for driving the various stages of the turbine section in rotation.

In conventional turbomachines, the distribution of air passing in succession through the compression section 100, the combustion section 200, and the turbine section 300 takes place as follows. The compressed air from the last stage of 102 of the compression section 100 naturally possesses gyratory motion with an angle of inclination of the order of 35° to 45° relative to the longitudinal axis X-X of the turbomachine. The guide vane 210 of the combustion section 200 serves to bring this angle of inclination back to 0°. Finally, at the inlet to the turbine section 300, the gas coming from combustion is redirected by the stationary vanes 310 of the nozzle 308 in order to impart gyratory motion thereto at an angle of inclination relative to the longitudinal axis X-X that is greater than 70°.

The invention provides a novel architecture for the combustion chamber 202 that can be fed with air that possesses gyratory motion about the longitudinal axis X-X of the turbomachine. By means of such architecture, it is possible to conserve the natural angle of inclination of the compressed air coming from the last stage of the compression section, without it being necessary to straighten it relative to the longitudinal axis X-X. Similarly, it is no longer necessary for the stationary vanes 310 of the nozzle 308 of the turbine section 300 to present such a large angle of inclination in order to produce the angle of attack needed to provide the mechanical force for driving the moving wheel 302 of the first stage of the turbine section in rotation.

For this purpose, the combustion chamber 202 invention comprises an inner annular wall 212 centered on the longitudinal axis X-X of the turbomachine, an outer annular wall 214 likewise centered on the longitudinal axis X-X and surrounding the inner wall so as to co-operate therewith to define an annular space 216 forming a combustion center, and a transverse annular wall 218 (referred to as the chamber end-wall) transversely interconnecting the longitudinal ends of the inner and outer walls.

The inner wall 212 of the combustion chamber has a plurality of internal steps 220 that are regularly distributed around the longitudinal axis X-X. Each of these internal steps 220 extends longitudinally between the two longitudinal ends (upstream and downstream) of the inner wall, and extends radially towards the outside thereof.

In other words, the inside surface of the inner wall 212 is profiled with a plurality of steps 220 that project towards the outside of the wall. Furthermore, the term "inner cavity" 222 is used to designate the circumferential space that is defined between two adjacent internal steps 220.

Similarly, the outer wall 214 of the combustion chamber includes a plurality of outer steps 224 that are regularly distributed around at the longitudinal axis X-X. Each outer step 224 extends longitudinally between the two longitudinal ends of the outer wall, and extends radially towards the inside thereof.

In a manner analogous to the inner wall, the outer surface of the outer wall 214 is profiled with a plurality of steps 224 projecting towards at the inside of the wall. The term "outer cavity" 226 is used to designate the circumferential space that is defined between two adjacent outer steps 224.

Still according to the invention, at least some of the inner cavities 222 and at least some of the outer cavities 226 are fed with fuel in a direction that is substantially radial.

For this purpose, the combustion chamber 202 of invention further includes a plurality of fuel injection systems 228 distributed over the inner and outer walls 212 and 214 around at the longitudinal axis X-X of the turbomachine, and opening out into the combustion area 216 in a direction that is substantially radial.

Figure 2:
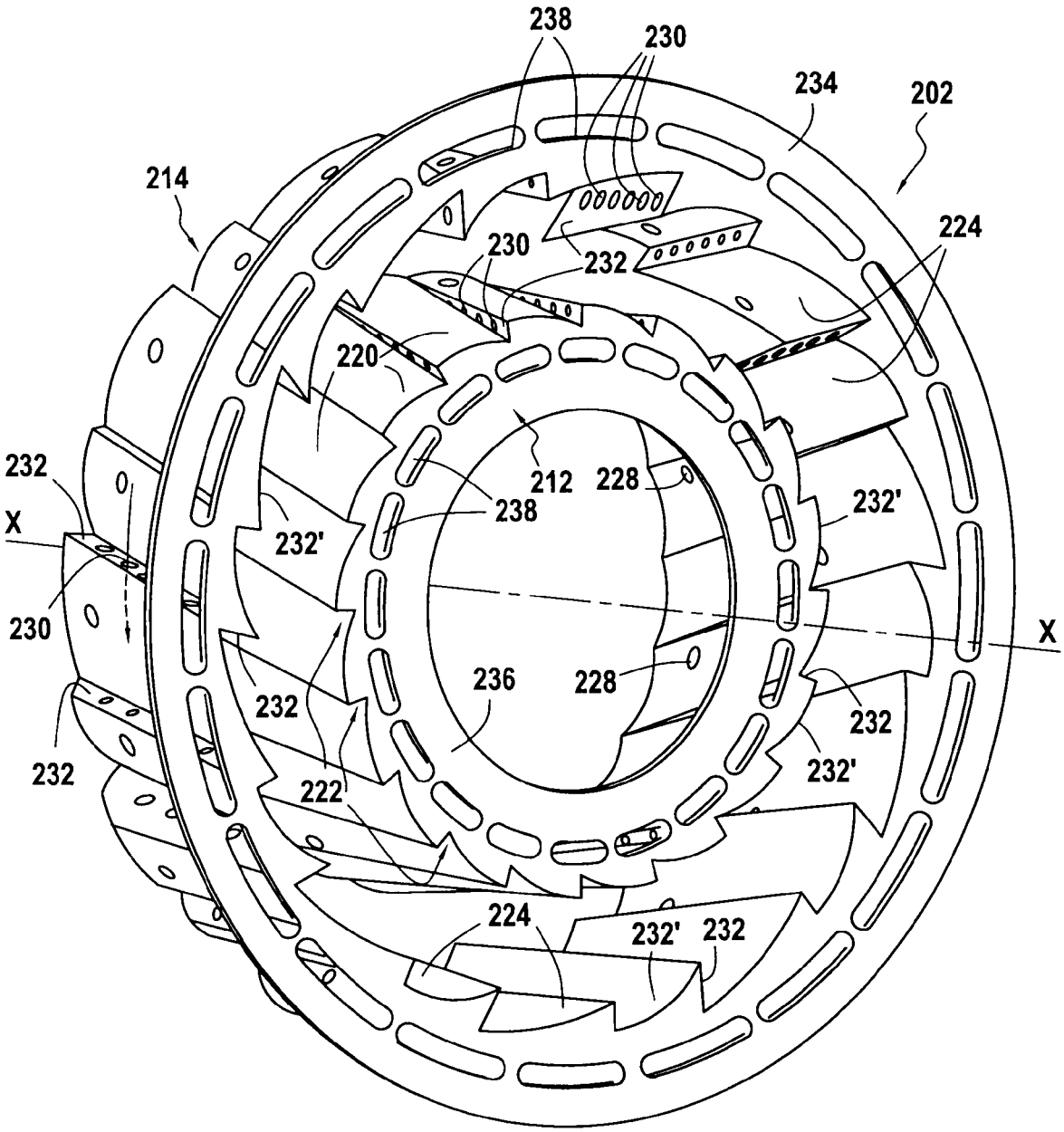
FIG. 2 is a perspective view of the combustion chamber of FIG. 1.
Figure 3:
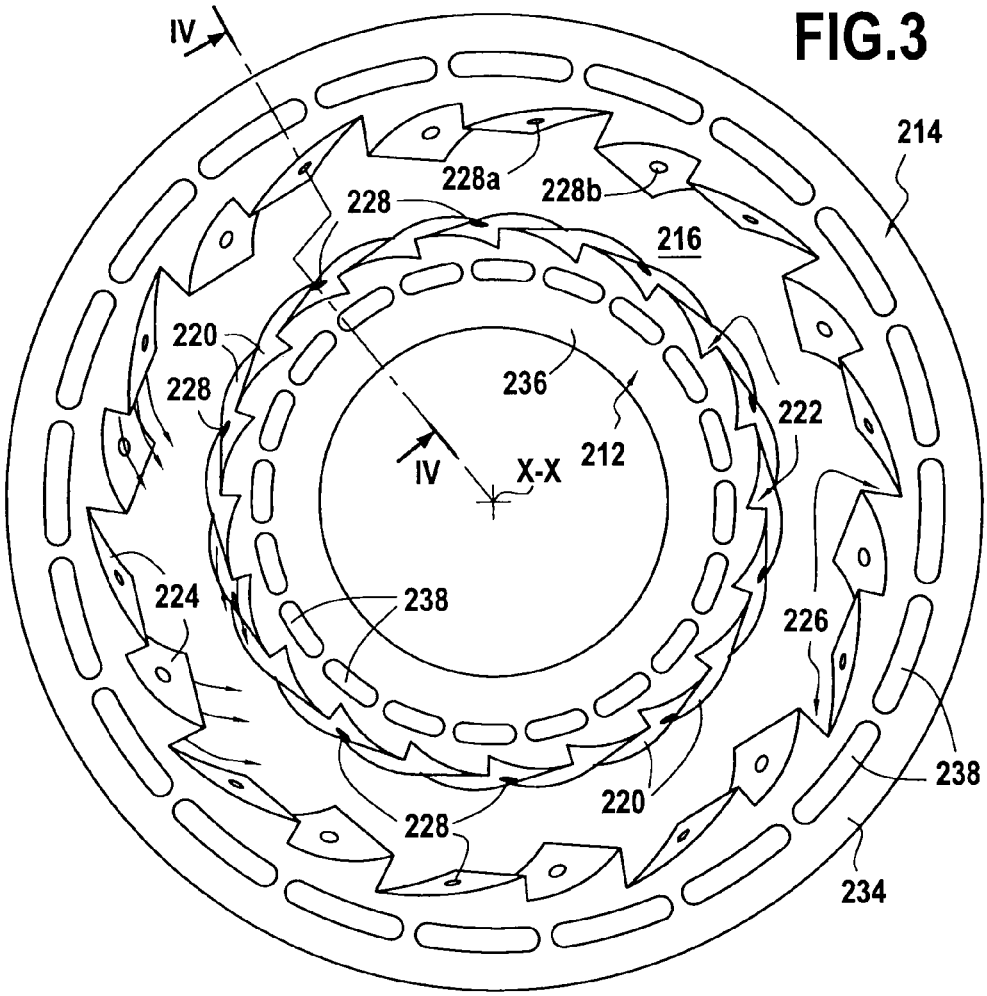
FIG. 3 is a face view of FIG. 2.

More precisely, as shown in FIGS. 2 and 3, the fuel injection systems 228 open out radially into at least some of the inner cavities 222 and into at least some of the outer cavities 226.

Figure 4:
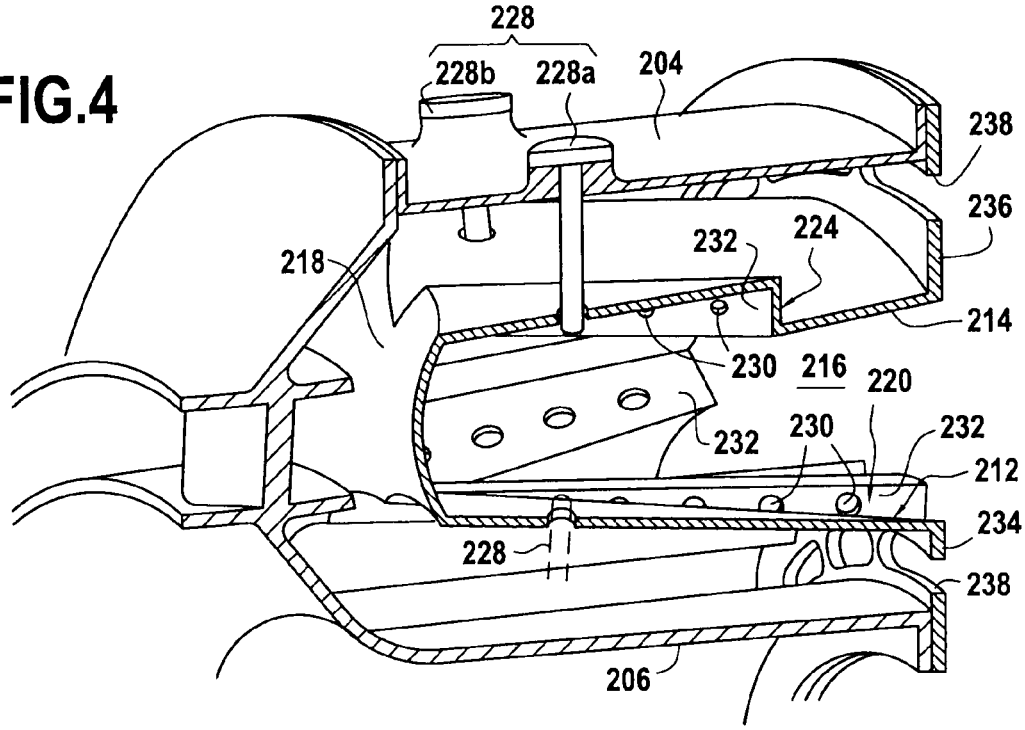
FIG. 4 is a section view on IV-IV of FIG. 3.

Thus, in the embodiment of FIGS. 2 to 4, the fuel injection systems 228 open out into all of the outer cavities 226 and into only every other inner cavity 222. Naturally, other configurations are possible: all of the inner cavities and all of the outer cavities could be fed with fuel; only every other outer cavity together with all of the inner cavities could be fed with fuel; etc. The principle governing how the feed configuration for the cavities is selected relies on optimizing the performance of the combustion chamber for each point in the flight range.

Advantageously, the fuel injection systems 228 include pilot injectors 228*a* alternating circumferentially with full-throttle injectors 228*b*.

Thus in the embodiment of FIGS. 2 to 4, the fuel injection systems 228 feeding the outer cavities 226 do indeed comprise an alternation of pilot injectors 228*a* with full-throttle injectors, and the fuel injection systems 228 feeding the inner cavities 222 comprise full-throttle injectors and pilot injectors.

Conventionally, the pilot injectors 228*a* serve for ignition and for stages when the turbomachine is idling, while the full-throttle injectors 228*b* act during the stages of takeoff, climbing, and cruising. In general, the pilot injectors are fed with fuel continuously, while at the takeoff injectors are fed only above a certain determined speed.

According to an advantageous particular feature of invention, the fuel injection systems 228 are not associated with air systems, such as air swirlers, that would conventionally serve to generate a rotary flow of air within the combustion area for the purpose of a stabilizing the combustion flame.

Thus, the pilot injectors and the full-throttle injectors of the combustion chamber are of very simple design and they operate very reliably since they have nothing to perform other than their most basic function, namely that of injecting fuel. In addition, the pilot injectors 228*a* are of the same type as the full-throttle injectors 228*b*.

Furthermore, unlike the embodiment shown in FIGS. 2 to 4, the full-throttle injectors 228*b* could be axially offset downstream from the pilot injectors 228*a*.

Still in accordance with the invention, at least some of the inner cavities 222 and at least some of the outer cavity is 226 are fed air external to the combustion chamber 202, all in the same substantially circumferential direction.

To this end, the inner cavities 222 and the outer cavities 226 are fed with air by means of a plurality of air injection orifices 230 formed through a substantially radial wall 232 of the corresponding inner and outer steps 220 and 224. These air injection orifices 230 are open to the outside of the combustion chamber 202 and to the corresponding inner or outer cavity in a direction that is substantially circumferential.

Thus, in the embodiment shown in FIGS. 2 to 4, all of the inner cavities 222 and all of the outer cavities 226 are fed with air by means of such air injection orifices (i.e. even those inner cavities that are not fed with fuel). Naturally, other configurations are possible depending on requirements: it is possible for only some of the inner cavities and only some of the outer cavities to be fed with air.

It should be observed that air is injected circumferentially into the combustion area 216 in the same direction of rotation (clockwise in the embodiment shown in FIGS. 2 and 3) for all of the inner cavities 222 and for all of the outer cavities 226 of the combustion chamber. Furthermore, the air that is injected circumferentially into the cavities rotates in the same direction as the compressed air coming from the compression section of the turbomachine.

It should also be observed that air is fed to the combustion area 206 solely by means of the air injection orifices 230 opening out into some of the inner and outer cavities in a circumferential direction (a very small fraction of air also penetrates into the combustion area by passing through multi-perforation holes that are formed in the walls 212, 214, and 218 of the combustion chamber in order to cool those walls, these holes not being shown in the figures).

Finally, the inner and outer cavities that are fed with fuel are not necessarily uniform concerning their radial dimensions (i.e. the heights of the corresponding steps), nor concerning their circumferential dimensions, in order to cause residence time to vary depending on the cavity under consideration. Similarly, as shown in FIG. 4, the heights of the steps are not necessarily constant along the entire length of the wall (i.e. between its upstream and downstream ends). Furthermore, the flow rate of air feeding these cavities can vary depending on the cavity under consideration.

The combustion chamber operates as follows: compressed air coming from the compression section 100 and that is in rotation about the longitudinal axis X-X penetrates into the combustion section 200. This air goes round the combustion chamber 202 and feeds at least some of the inner cavities 222 and of the outer cavities 226 after cooling the walls and the shells of the combustion chamber. This air is injected into these cavities via the air injection orifices 230, flowing in the direction of rotation of the air at its entry into the combustion chamber. In some of these cavities that are fed with air, the air is mixed and burnt with fuel injected by the fuel injection systems 228.

Variant embodiments of the combustion chamber of invention are described below.

In the embodiment of FIGS. 2 and 3, each of the inner and outer steps 220 and 224 of the combustion chamber includes another wall 232' (opposite the wall 232 provided with air injection orifices) that extends in a direction that is substantially circumferential, and that presents, in cross-section, a section that is substantially curvilinear (unlike the wall 232 that is substantially plane and radial). The curvature of this wall makes it possible to form a ramp for accompanying the rotary movement of the air injected into the cavities via the air injection orifices 230. Naturally, it is possible to envisage any other shape of wall (plane or curvilinear).

In general, the number and the geometrical dimensions of the inner and outer cavities of the combustion chamber can vary depending on requirements. The same applies to the number, the dimensions, and the positioning of the air injection orifices in the said cavities, and also to be circumferential positions of the fuel injection systems relative to the inner and outer steps.

Finally, as shown in FIGS. 1 to 4, each of the inner and outer walls 212 and 214 of the combustion chamber may have an annular flange at its downstream end, given respective reference 234 or 236, which flanges are provided with a plurality of holes 238 that are regularly distributed around the longitudinal axis X-X and serve to feed cooling air to the turbine section 300.

What is claimed is:

1. A turbomachine combustion chamber comprising:

an inner annular wall of longitudinal axis;

an outer annular wall centered on the longitudinal axis and surrounding the inner wall so as to co-operate therewith to define an annular space forming a combustion area;

a transverse annular wall transversely interconnecting an upstream longitudinal end of the inner wall and an upstream longitudinal end of the outer wall; and a plurality of fuel injection systems;

wherein:

the inner wall includes a plurality of inner steps that are regularly distributed around the longitudinal axis, each inner step extending longitudinally between the upstream longitudinal end and a downstream longitudinal end of the inner wall and radially towards the outside thereof, the circumferential spacing between two adjacent inner steps defining an inner cavity;

the outer wall includes a plurality of outer steps that are regularly distributed around the longitudinal axis, each outer step extending longitudinally between the upstream longitudinal end and a downstream longitudinal end of the outer wall and radially towards the inside thereof, the circumferential spacing between two adjacent inner steps defining an outer cavity; and the combustion chamber is configured to feed air external to the combustion chamber to at least one of the inner cavities and at least one of the outer cavities in a common direction that is substantially circumferential, and the fuel injection systems are configured to feed fuel to at least one of the inner cavities and at least one of the outer cavities in a direction that is substantially radial.

2. A combustion chamber according to claim 1, in which at least one of the inner steps and at least one of the outer steps include respective substantially radial walls, each substantially radial wall provided with a plurality of air injection orifices opening to the outside of the combustion chamber and into the adjacent inner or outer cavity.

3. A combustion chamber according to claim 2, in which each of the inner and outer steps includes a respective other wall that includes, in cross-section, a section that is substantially curvilinear.

4. A combustion chamber according to claim 1, in which the fuel injection systems comprise pilot injectors alternating circumferentially with full-throttle injectors.

5. A combustion chamber according to claim 4, in which the full-throttle injectors are offset axially downstream relative to the pilot injectors.

6. A combustion chamber according to claim 1, in which the fuel injection systems do not include associated air systems.

7. A turbomachine that includes a combustion chamber according to claim 1.

8. A combustion chamber according to claim 1, in which the fuel injection systems are configured to feed all of the outer cavities with fuel.

9. A combustion chamber according to claim 8, in which the fuel injection systems are configured to feed all of the inner cavities with fuel.

10. A combustion chamber according to claim 8, in which the fuel injection systems are configured to feed every other inner cavity with fuel.

11. A combustion chamber according to claim 1, in which all of the inner cavities are fed with air external to the combustion chamber.

12. A combustion chamber according to claim 1, in which all of the outer cavities are fed with air external to the combustion chamber.

13. A combustion chamber according to claim 1, in which the air fed to at least one of the inner cavities and at least one of the outer cavities rotates in the same direction as compressed air coming from a compression section of the turbomachine.

14. A combustion chamber according to claim 1, in which an annular flange is disposed at the downstream longitudinal end of the inner wall.

15. A combustion chamber according to claim 14, in which the flange is provided with a plurality of holes regularly distributed around the longitudinal axis, said holes configured to feed cooling air to a turbine section of the turbomachine.

16. A combustion chamber according to claim 1, in which an annular flange is disposed at the downstream longitudinal end of the outer wall.

17. A combustion chamber according to claim 16, in which the flange is provided with a plurality of holes regularly distributed around the longitudinal axis, said holes configured to feed cooling air to a turbine section of the turbomachine.

* * * * *